US006475003B2

(12) United States Patent
Jones et al.

(10) Patent No.: US 6,475,003 B2
(45) **Date of Patent: *Nov. 5, 2002**

(54) PHYSICALLY INDEPENDENT CONNECTOR FOR RETRACTABLE AND REMOVEABLE EXTENSIONS IN THIN-PROFILE ELECTRONIC DEVICES

(75) Inventors: Jeffrey L. Jones, Orem, UT (US); Brent Madsen, Providence, UT (US)

(73) Assignee: 3Com Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/415,964

(22) Filed: Oct. 12, 1999

(65) Prior Publication Data

US 2002/0013094 A1 Jan. 31, 2002

(51) Int. Cl.[7] ..... H01R 13/44
(52) U.S. Cl. ..... 439/131; 439/32; 439/824
(58) Field of Search ..... 439/131, 676, 439/32, 824; 361/64, 107, 188, 395

(56) References Cited

U.S. PATENT DOCUMENTS 3,254,344 A 5/1966 Rohrs ..... 343/901
4,695,925 A * 9/1987 Kodai et al. ..... 361/737
5,338,210 A * 8/1994 Beckham et al. ..... 439/131
5,727,966 A 3/1998 Alpert ..... 439/418
5,816,832 A * 10/1998 Aldous et al. ..... 439/131
5,828,343 A 10/1998 MacDonald, Jr. et al. .. 343/702
5,867,131 A 2/1999 Camp, Jr. et al. ..... 343/797
5,918,163 A 6/1999 Rossi ..... 455/90
5,926,138 A 7/1999 Eerikainen ..... 343/702
5,971,777 A * 10/1999 Gardside ..... 439/131
5,973,645 A 10/1999 Zigler et al. ..... 343/702
5,975,927 A * 11/1999 Giles ..... 439/131
6,033,240 A * 3/2000 Goff ..... 439/131
6,054,954 A 4/2000 Eggleston et al. ... 343/700 MS
6,059,583 A * 5/2000 Croft et al. ..... 439/131

* cited by examiner

*Primary Examiner*—Tho D. Ta
*Assistant Examiner*—Edwin A. León
(74) *Attorney, Agent, or Firm*—Kirton & McConkie; Michael F. Krieger

(57) ABSTRACT

The present invention relates to a removable and/or retractable extension for an electronic apparatus which is connected to the apparatus with a physically independent electrical connector which enables the extension to be retracted, extended, removed and replaced without connection or disconnection of wires, cables, plugs, jacks, flex connectors and similar devices which physically restrain the extension. Preferred embodiments of the present invention include longitudinally extensible conductors or leaf-spring conductors to provide a physically independent electrical connection between the retractable and/or removable extension and its host electronic apparatus. The extensions of some embodiments of the present invention include antennas, physical/electrical media connectors and similar electrical and electronic devices.

15 Claims, 4 Drawing Sheets

PHYSICALLY INDEPENDENT CONNECTOR FOR RETRACTABLE AND REMOVEABLE EXTENSIONS IN THIN-PROFILE ELECTRONIC DEVICES

THE FIELD OF THE INVENTION

The present invention relates to physical/electrical media connectors used in the computer and communications industry. More particularly, the present invention relates to an electrical connector used for connecting an electronic communications apparatus to a retractable extension of that apparatus. The present invention utilizes spring-loaded, longitudinally extensible conductors and spring-loaded elastically bendable leaf-spring conductors to effectuate an electrical connection between a sliding, retractable extension and an associated thin-profile electronic apparatus.

BACKGROUND

Electronics connectors in the computer and communications industry are available for a wide array of applications from communications and data transfer applications to power connections. Due to the pace of technology in this area and the trend toward smaller, more efficient and more capable hardware, connectors evolve on an almost daily basis. A plethora of standards have evolved for specific connector and hardware applications, however proprietary connectors also proliferate throughout the industry.

Some standards in the electrical connector industry have been created by government regulation such as the Federal Communications Commission's Title 47,§68.500, otherwise denoted "Subpart F—Connectors" (Subpart F). Subpart F is incorporated herein by reference. Subpart F contains detailed specifications for "miniature" connectors used in the communications industry. Included in this specification are the "Miniature 6-position plug and jack" and the "Miniature 8-position plug and jack." These connectors, commonly known as the RJ-11 connector and the RJ-45 connectors, respectively, are ubiquitous throughout the industry.

The miniature 6-position connector or RJ-11 has emerged as the industry standard connector for telephone lines. RJ-11 plugs and jacks are used on almost all telephone sets for connection to the phone system and consequently are used for standard modem connections which also use these telephone lines. Although most telephone companies use only 4 or 2 of the available positions on the connector, the 6-position connector is the standard.

The miniature 8-position connector or RJ-45 has become an industry standard connector for computer networks. It is used for inter-connectivity between network adapter cards, hubs, routers, switches and other network hardware.

These connectors have been the industry standard for many years and are likely to remain so in the future for telephones, desktop computer modems and network adapters, and other substantially stationary communications equipment. However, hardware technology and the "miniaturization" of components has progressed to the point that the standard, "miniature" RJ connectors have a larger cross-section than the thickness of the hardware to which they connect.

An example of these smaller, thin profile hardware configurations is the PC Card Standard promulgated by the Personal Computer Memory Card International Association (PCMCIA). The PCMCIA PC Card standard identifies three primary card type designations: Type I, II and III. These type designations correspond to physical dimension restrictions or "form factors" of 85.6 mm (length)×54.0 mm (width) and thicknesses of 3.3 mm, 5.0 mm and 10.5 mm respectively. These thin profile expansion cards are used to expand the functionality of computers and related products by adding circuitry contained on the card to the host device. Host devices, such as laptop computers, contain expansion slots which receive the expansion cards and provide electrical connections thereto. Modems and network adapters are often constructed in PC Card standard form factor.

As a consequence of hardware miniaturization in the face of a nearly worldwide RJ connector standard, hardware manufacturers have developed myriad proprietary hardware connection standards and an assortment of connectors and adapters that allow the RJ plugs to be connected to thin profile hardware.

One elegant and convenient connector which allows connection of the standard RJ type plug with thin profile hardware is the XJACK® produced by 3Com Corporation, Salt Lake City, Utah. The XJACK®, shown generally in FIG. 3, is a thin profile connector designed to be contained within hardware such as PC Card standard compliant devices. The XJACK® comprises a thin body 60 with an aperture 62 therein for receiving a standard RJ connector plug 64 or some other connector. Jack conductors 66 contact plug conductors 68 just as a conventional RJ jack connects. The XJACK® may be retractable within the device or be detachable therefrom. Commonly used XJACK® connectors retract in and out of a device by sliding along a track. A spring is often used to bias the XJACK® connector such that it pops out of its retracted state and remains extended during use.

Wireless communication devices are now becoming commonplace in the electronics industry. Wireless networking of portable computers and associated devices is now replacing a large segment of the networking market. Wireless communication devices including wireless networking adapters, hubs and other equipment utilize radio transmitters and receivers to transmit data signals from one device or node to another. These radio transmitters and receivers must utilize a specific frequency band and protocol to accomplish this task. Since these wireless networks and communications areas may often overlap, standards, protocols and privacy protection are necessary. One current standard in the industry has been established by the Institute of Electrical and Electronics Engineers, Inc. (IEEE) and is known as IEEE 802.11. This standard comprises communications standards, protocol and equipment specifications for wireless communication equipment including privacy and encryption provisions.

Another emerging standard in wireless communications and networking, known as Bluetooth®, is being established by a collaborative group of communications and computing companies. Devices incorporating Bluetooth® technology will utilize a micro-chip transceiver for communications between devices. Bluetooth® devices will transmit in the previously unused 2.4 GHz range. Bluetooth® technology promises to be a viable and economical networking solution for interconnection of cell phones, computers, printers, modems, computer peripherals, fax machines and other communications and computing devices. The size of the Bluetooth® transceiver will make it usable in devices as small as palm computers and cell phones.

Antennas are well known for enabling and improving transmission to radio receivers and from radio transmitters.

Antennas can dramatically increase the range of radio transceivers, however most antenna designs function best when protruding from their host device. In small electronic devices protruding antennas are often vulnerable to breakage as the devices are often stowed in purses, pockets, backpacks and other areas where neglect can occur. Often a retractable antenna is more convenient and durable. Further convenience is afforded through an antenna which can be easily replaced through a removable attachment.

When antennas are incorporated into thin-profile devices such as PC Card standard expansion cards, very little space is left above and below the antenna. This lack of space makes electrical connection difficult to achieve at the top or bottom of the antenna. The metal case on many PC Card standard cards makes top and bottom connections even more problematic as electrical shorting to the case must be precluded. Consequently, edge connections are desirable in these applications.

While wireless technology is fast replacing a large segment of the communications and networking industry, wired equipment is still prevalent. A communications or computing device, such as a portable computer, which can connect to both wireless and conventionally wired networks will be more adaptable and convenient at the present time. A device or expansion card which provides connectivity to both wired and wireless technology is extremely useful.

SUMMARY AND OBJECTS OF THE INVENTION

The present invention relates to physically-independent connection methods and apparatus for connecting a retractable and/or removable extension to a host electronic apparatus. This extension may comprise an RF antenna, physical/electrical media connector or similar electronic device. Connection apparatus of the present invention comprise longitudinally extensible conductors which extend from a physical and electrical connection on a host device's printed circuit board (PCB) to electrical contact points on a retractable and/or removable extension. Conversely, the spring-loaded longitudinally extensible conductors of the present invention may be physically and electrically attached to retractable extensions and extend to make electrical contact with circuitry on a host apparatus.

An alternative embodiment of the present invention utilizes leaf spring conductors which protrude from a holder/connector which may be located on a host device or on a retractable or removable extension. The leaf springs extend outwardly and are biased so as to contact complementary contacts on the associated extension or device. For example, a sliding, retractable antenna may travel along a path and may have electrical contacts along its side. The associated host device in which the antenna resides may have leaf spring type conductors which extend adjacent to the path of the antenna and contact the side of the antenna throughout the length of the path or a portion thereof.

Regardless of their physical form the apparatus and methods of the present invention form a physically independent, wireless, cable-less, plug-less electrical connection between a movable or retractable unit and a host electronic apparatus. This physically independent connection allows for convenient replacement of the movable unit or extension. A specific extension or unit may be replaced with an identical unit for repair or an alternative extension may be interchanged for increased connectivity.

Some embodiments of the present invention comprise alternative electronic extensions that may be interchanged or swapped. One alternative extension is a removable retractable antenna. Another alternative extension is a physical/electrical media connector such as XJACK®. The antenna portion of the device is embodied in a thin retractable extension which may be removed and replaced with the alternative extension comprising a physical/electrical media connector. When the retractable physical/electrical media connector extension is used, the device may be physically and electrically connected to a wired network cable through the physical/electrical media connector. When the retractable antenna extension is used, the apparatus may be connected to a wireless network or device through the antenna built into the extension. The interchangeable extensions of the present invention may be used in conjunction with combination expansion cards containing network adapters, modems and other electronic devices which require alternative electrical connectivity. An alternative antenna or thin-profile connector may be connected for each device or function of the combo card.

Some embodiments of the present invention may also comprise switching mechanisms which activate or control functions of an electronic device according to the relative position of the retractable and/or removable extension or the specific type of extension in use.

Accordingly, it is an object of some embodiments of the present invention to provide a physically independent electrical connection between an electronic device and a retractable extension thereof.

It is also an object of some embodiments of the present invention to provide an electrical connection between an electronic device and an associated retractable extension.

It is another object of some embodiments of the present invention to provide an electrical connection between an electronic device and a retractable physical/electrical media connector. These and other objects and features of the present invention will become more fully apparent from the following, description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The figures listed above are expressly incorporated as part of this detailed description.

It will be readily understood that the components of the present invention, as generally described and illustrated in the Figures herein, could be arranged and designed in a wide variety of different configurations. Thus, the following more detailed description of the embodiments of the system and apparatus of the present invention, as represented in FIGS. 1 through 4B, is not intended to limit the scope of the invention, as claimed, but it is merely representative of the presently preferred embodiments of the invention.

The currently preferred embodiments of the present invention will be best understood by reference to the drawings, wherein like parts are designated by like numerals throughout.

The Personal Computer Memory Card International Association (PCMCIA) promulgates the PC Card Standard for thin profile or thin architecture expansion cards for electronic devices. The PC Card standard designates the physical dimensions of the cards as well as the electrical configuration of the cards including the 68-pin interface between the card and the host device. The physical dimensions of cards conforming to this standard are 85.6 mm in length by 54.0 mm in width. Several thickness variations fall within the standard and are designated by type designation. Type I, II, and III PC Cards have thicknesses of 3.3 mm, 5.0 mm and 10.5 mm respectively. Any references to the PC Card Standard or PCMCIA card standard refer to electronic cards substantially conforming to this standard as described herein.

The term miniature modular jack, physical/electrical media connector, fixed jack, XJACK, alligator jack, and the like, connotes a media connector that may have qualities such as those connectors having physical attributes described in F.C.C. Part 68, Subpart F. Specific terms such as RJ-type, RU-11, RJ-45, 6-pin miniature modular plug, 8-pin miniature modular plug, and similar terminology are all references to specific exemplary physical/electrical media connectors falling within the broader parameters of the term physical/electrical media connectors and are cited by way of example and should not be used to limit the scope of the present invention to specific connectors.

Figure 1A:
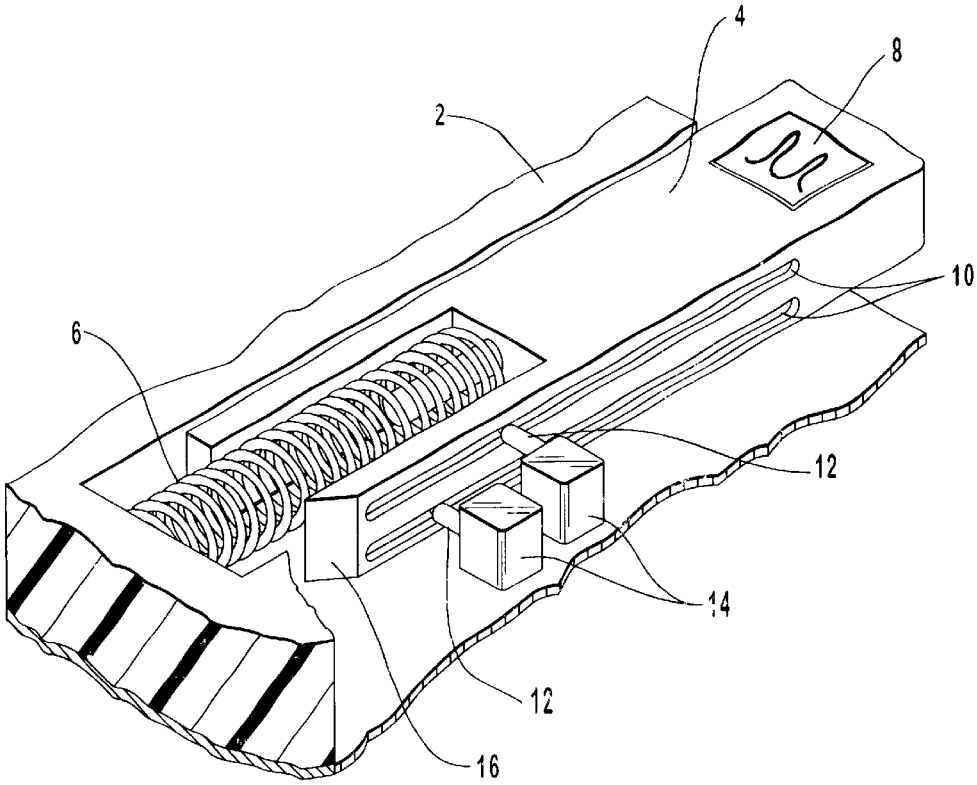
FIG. 1A is a perspective view of a retractable extension of an electronic device.

In reference to FIG. 1A, a first embodiment of the present invention is shown in a cut-away perspective view. This embodiment comprises an electronic device having a housing 2 which defines a track or path for a retractable extension 4. Retractable extension 4 is free to travel inward and outward from housing 2 and may be biased with a spring 6 or other mechanism to maintain a default position. Retractable extension 4 may comprise electronic circuitry 8 for expansion of or connection to the electronic device. Electronic circuitry 8 may comprise, for example and not by way of limitation, a patch antenna, an inverted F antenna, a monopole antenna, a dipole antenna, a transmitter, a transceiver or a physical/electrical media connector such as a plug or a jack.

This first embodiment further comprises one or more electrically conductive surfaces 10 along the side of extension 4. Surfaces 10 are electrically connected to the electronic circuitry 8 within extension 4. Longitudinally extensible conductors 12 are mounted to the PCB or other static portion of the device and are electrically connected to the device's circuitry using known methods. Extensible conductors 12 extend from the static portion of the device and contact conductive surfaces 10 on retractable extension 4 such that retractable extension 4 is free to move along its path while extensible conductors 12 maintain electrical contact with retractable extension 4. Extensible conductors 12, thereby form a physically independent electrical connection between extension 4 and its associated device. For optimum freedom of movement of retractable extension 4 the force exerted by extensible conductors 12 should be less than 50 grams. Conductive surfaces 10 may extend along the side of retractable extension 4 a sufficient length to maintain constant contact with extension 4 throughout its entire path of extension and retraction or surfaces 10 may be located at specific positions along a path so as to perform a switching function such that electronic circuitry 8 on extension 4 is activated or connected only while extension 4 is extended, retracted or at some other position or range of positions.

Longitudinally extensible conductors 12 may attach directly to the PCB of the device using known surface mount techniques. Extensible conductors 12 may have a base unit 14 configured for surface mount techniques. For optimum utility in the surface mount "pick and place," or "tape & reel" processes, the width of base unit 14 should be greater that its height. Base unit 14 may also be configured to mount to other static portions of the device which contain electrical conductors which may connect to extensible conductors 12.

Figure 1B:
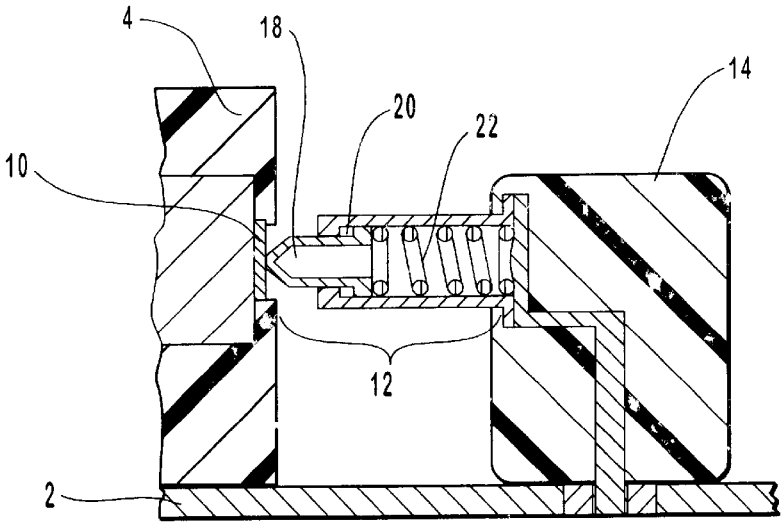
FIG. 1B is a cross-sectional view of spring-loaded longitudinally extensible conductors for connection with a retractable extension of an electronic device.

In reference to FIGS. 1A and 1B, longitudinally extensible conductors 12 may be constructed to facilitate complete removal and replacement of extension 4. When extensible conductors 12 are oriented perpendicular to the path of extension 4 they may be constructed with a beveled or rounded tip 18 and a detent mechanism 20 which prevents extensible conductors 12 from extending fully into the path of extension 4. Detent mechanism 20 ensures that extensible conductors 12 will not block the path of extension 4 once it has been removed from the device so that extension 4 may be reinserted into its path without obstruction. Extension 4 may also have a beveled corner surface 16 which serves to retract extensible conductors 12 as extension 4 is being inserted in its path. As extension 4 is replaced into the device, beveled surface 16 and beveled tip 18 contact each other and gently push extensible conductor 12 into a slightly retracted position that allows extension 4 to enter its path while remaining in contact with extensible conductor 12.

Figure 2:
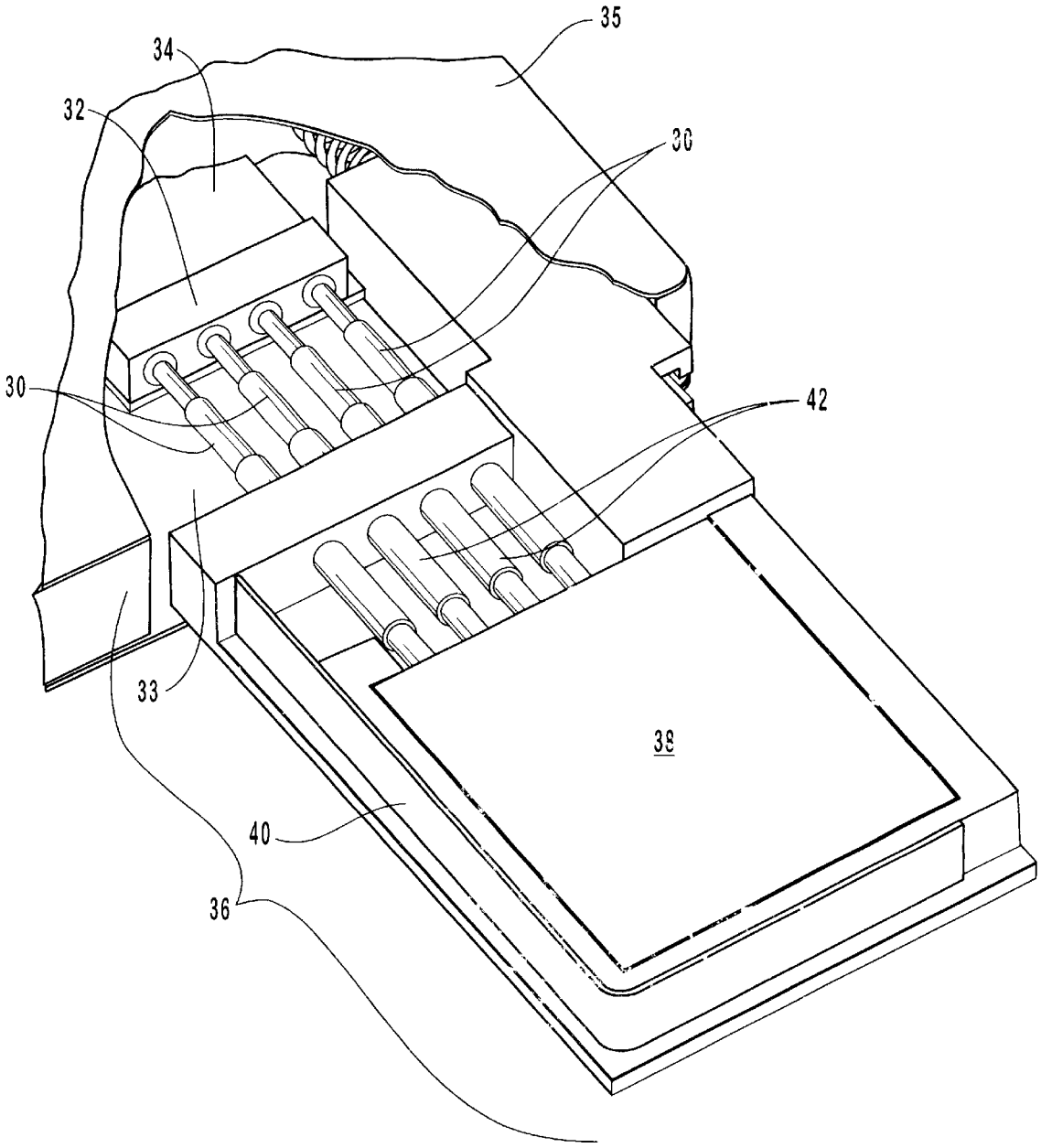
FIG. 2 is a perspective view of a retractable extension of an electronic device showing spring-loaded longitudinally extensible conductors oriented parallel to the path of the retractable extension.
Figure 3:
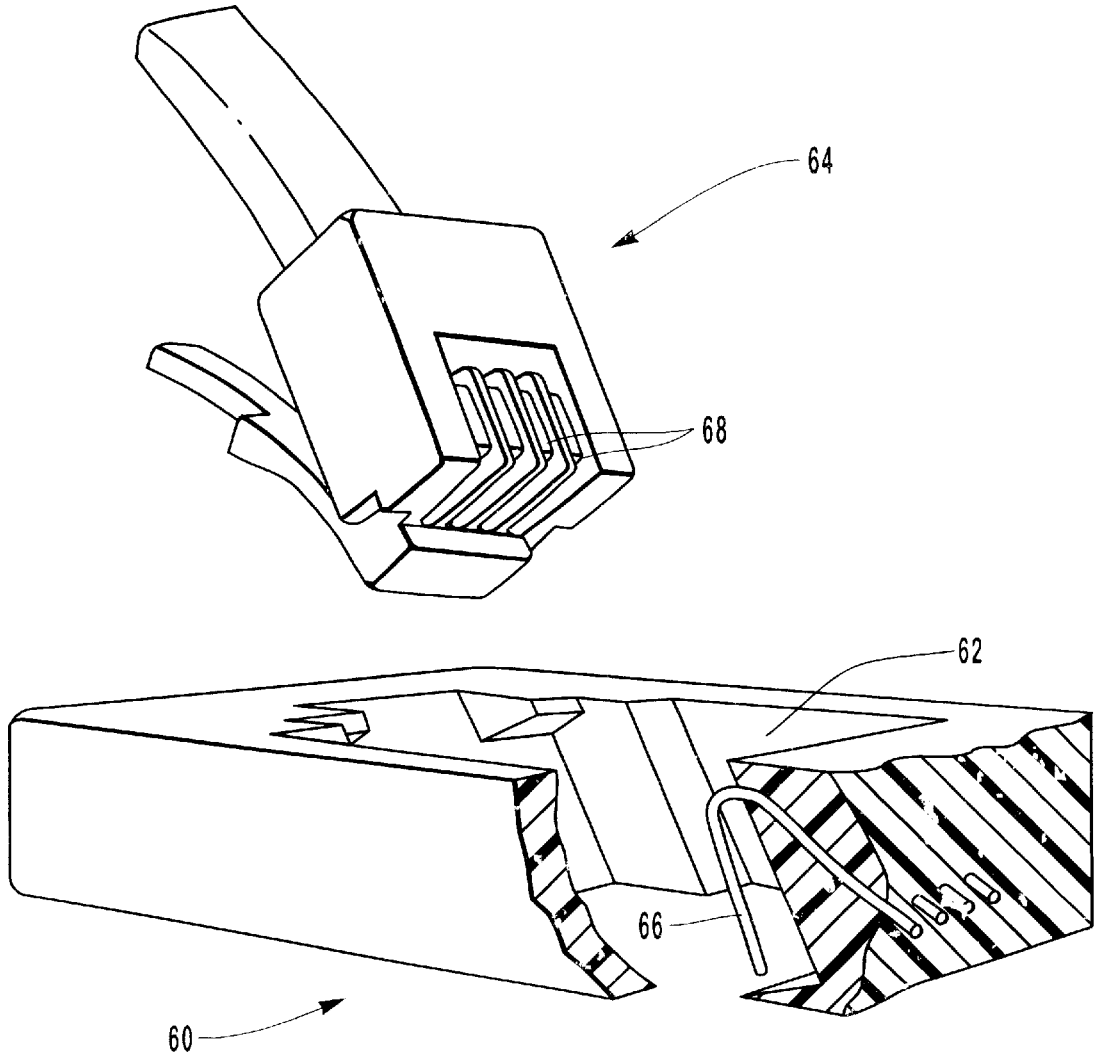
FIG. 3 is a perspective view of a conventional retractable extension incorporating a physical/electrical media connector.

A second embodiment of the present invention using longitudinally extensible conductors oriented parallel to the path of the extension is shown in FIG. 2 where multiple longitudinally extensible conductors 30 extend from a base unit 32 which is attached physically and electrically to PCB 34. Extensible conductors 30 are physically attached to base unit 32 such that extensible conductors 30 will remain attached to base unit 32 when retractable and removable extension 36 is extended or removed. Extensible conductors 30 extend to contact conductors on extension 36 thereby completing an electrical connection therewith when extension 36 is in a retracted or extended position within a host device. Extensible conductors 30 may also be configured so as to be physically connected to extension 36 and extend so as to contact base unit 32 to effectuate an electrical connection between extension 36 and PCB 34. Extensible conductors 30 facilitate the removal and replacement of extension 36 by automatically connecting a host device 35 thereto when extension 36 is placed within track 33 on host device 35. This automatic connection allows alternative extensions with different functionality to be quickly swapped and replaced to extend or expand the utility and connectivity of the host device.

For example, and not by way of limitation, extension 36 may contain one or more electronic circuits or elements such as a sleeved monopole antenna 40 or an inverted F antenna 38 which may be used with a transceiver for a wireless communications device. When a user leaves an area where the wireless communications device is usable these antennas 38 & 40 may become unusable and the user may want to replace them with a cable connector such as an RJ-11 jack or similar connector. This may be achieved by removing extension 36 from the host device and replacing extension 36 with an alternative extension containing a thin profile RJ-11 jack.

Alternatively, inverted F antenna 38 may be configured to be removable from extension 36 and connected thereto with internal extensible connectors 42 such that antenna 38 may be removed and replaced with an alternative element which automatically connects to extension 36 and its associated host device.

When retractable extension 36 is configured with extensible conductors 30 which are oriented parallel with the path of retractable extension 36, springs 22 within extensible conductors 30 may be used to bias extension 36 toward an extended position thereby eliminating or reducing the need for separate biasing springs for retractable extension 36.

Figure 4A:
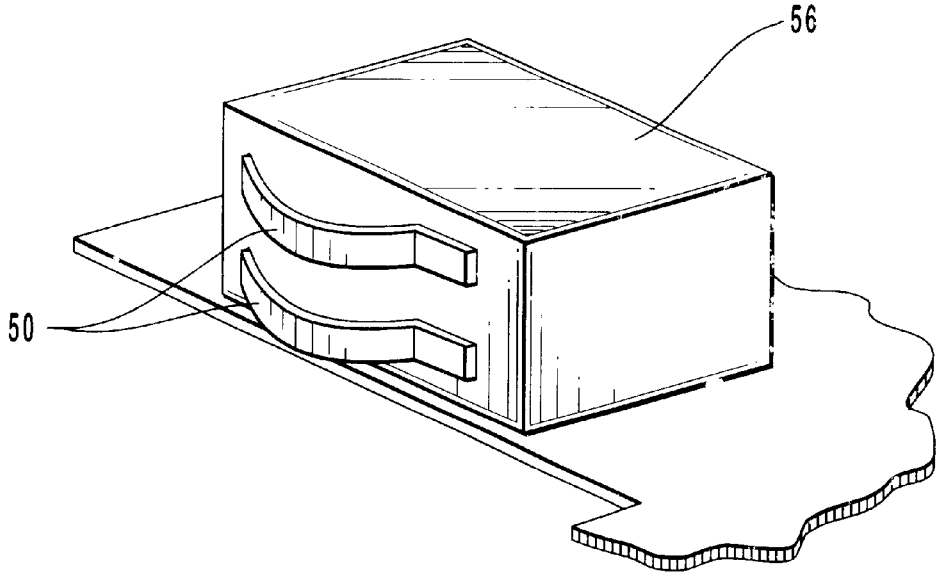
FIG. 4A is a perspective view of a base unit with leaf-spring conductors.
Figure 4B:
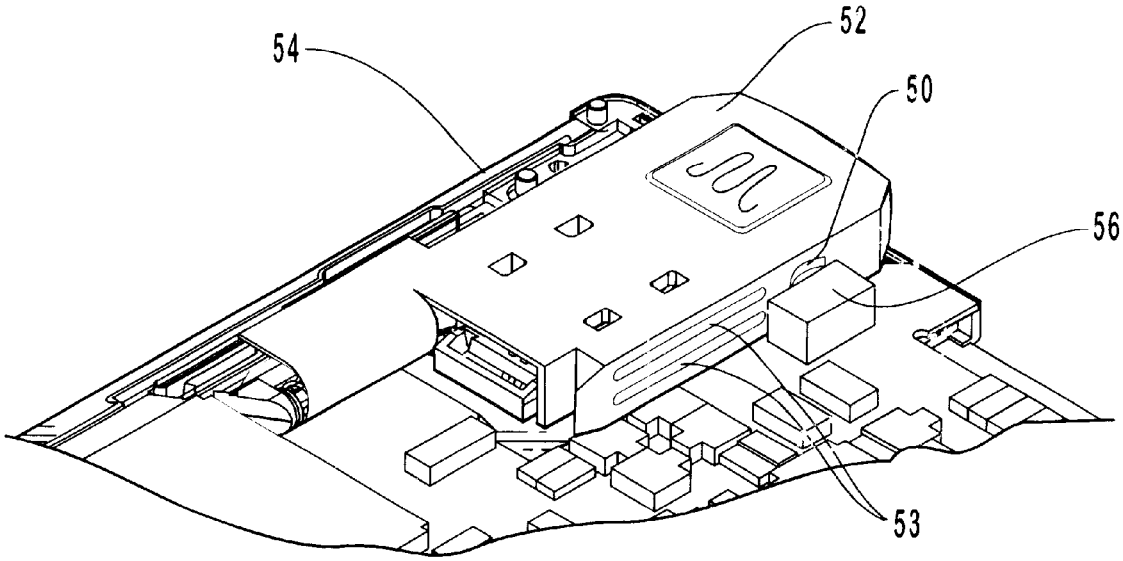
FIG. 4B is a perspective view of a retractable extension shown in an electronic apparatus.

Yet another embodiment of the present invention, shown in FIGS. 4A and 4B utilizes a leaf-spring conductor 50 to provide a physically independent electrical contact between a retractable or removable extension 52 and a host device 54. Leaf-spring conductors 50 typically form an arcuate shape which protrudes outwardly from a base unit 56. Leaf-spring conductors 50 are located adjacent to extension 52 such that they contact and deform elastically thereby exerting a light force against extension 52 thereby forming an electrical connection with extension 52 through electrical contact with electrically conductive surfaces 53. Preferably, leaf-spring conductors 50 will exert a force of less than 50 grams on extension 52 so as not to substantially restrain or inhibit the motion of extension 52.

Base unit 56 connects to a host device PCB 58 or other host device circuitry through surface mount techniques or other electrical connections. Base unit 56 will, preferably, have a base that is wider than its height for greater reliability in surface mount "pick and place," or "tape & reel" processes. It should be noted that leaf-spring conductors 50 may also be physically mounted on and electrically connected to retractable extension 52 and oriented to make electrical contact with conductive surfaces on a host device.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

We claim:

1. An electronic system comprising:

a computer device;

a thin-profile electronic apparatus coupled to the computer device and is configured to move between an extended position and a retracted position in relation to the computer device;

spring-loaded extensible connectors that couple the thin-profile electronic apparatus to the computer device, wherein at least one of the connectors is in an extended connecting position when the thin-profile electronic apparatus is in the extended position and is in a retracted connecting position when the thin-profile electronic apparatus is in the retracted position, and wherein one or more of the connectors electrically couple the thin-profile electronic apparatus to the computer device and provide a bias toward a side of the thin-profile electronic apparatus, and wherein each of the connectors is a wireless, cable-less, plug-less electrical connection between the thin-profile electronic apparatus and the computer device; and an information apparatus coupled to the thin-profile eletronic apparatus that is configured for use in exchanging information.

2. The electronic system of claim 1, wherein at least one of the connectors includes a longitudinally extensible member.

3. The electronic system of claim 1, wherein at least one of the connectors includes a leaf-spring conductor.

4. The electronic system of claim 1, wherein said information apparatus comprises an antenna.

5. The electronic system of claim 1, wherein said information apparatus comprises a thin profile physical/electrical media connector.

6. The electronic system of claim 1, wherein said thin-profile electronic apparatus includes one of a plurality of alternative extensions that may selectively provide alternative functionality to the electronic system.

7. A selectively removable computer expansion card comprising:

a selectively movable extension that is configured to move between an extended position and a retracted position; and spring-loaded extensible connectors that couple the extension to a computer system, wherein at least one of the connectors provides a bias toward a side of the extension and provides an electrical connection between the extension and the computer system.

8. The expansion card of claim 7, wherein said expansion card conforms to a PC Card standard.

9. The expansion card of claim 7, wherein said extension includes a thin profile retractable jack.

10. The expansion card of claim 7, wherein said extension includes one or more antennae, and wherein at least one of the one or more antennae is a selectively removable antenna.

11. The expansion card of claim 7, wherein said extension includes a selectively removable, thin profile physical/electrical media connector.

12. A retractable and removable antenna comprising:

a selectively movable extension that is configured to move between a retracted position interior to a computer device to an extended position exterior to said computer device;

spring-loaded extensible connectors that couple the extension to the computer device, wherein each of the connectors is a wireless, cable-less, plug-less electrical connection between the extension and the computer device, wherein at least one of the connectors is selectively and slidably coupled to an electrically conductive surface on a side of the extension to provide an electrical connection between said extension and said computer device.

13. The antenna of claim 12, wherein said at least one connector comprises at least one leaf-spring conductor aligned parallel with a path of movement of said movable extension.

14. The antenna of claim 12, wherein said at least one connector comprises at least one conductor aligned perpendicular with a path of movement of said movable extension, wherein the at least one conductor includes a longitudinally extensible member.

15. The antenna of claim 12, wherein said at least one connector allows said extension to be selectively removed and replaced without detaching wires.

* * * * *